US007735192B2

(12) United States Patent
deNormand

(10) Patent No.: US 7,735,192 B2
(45) Date of Patent: Jun. 15, 2010

(54) EXTENDED TRAVEL WINDOW BALANCE

(75) Inventor: Richard S deNormand, Victor, NY (US)

(73) Assignee: Caldwell Manufacturing Company, Rochester, NY (US)

( * ) Notice: Subject to any disclaimer, the term of this patent is extended or adjusted under 35 U.S.C. 154(b) by 211 days.

(21) Appl. No.: 11/427,040

(22) Filed: Jun. 28, 2006

(65) Prior Publication Data

US 2008/0000047 A1 Jan. 3, 2008

(51) Int. Cl.
*E05D 13/00* (2006.01)

(52) U.S. Cl. ..... 16/197; 16/193; 49/445

(58) Field of Classification Search ..... 16/191, 16/196–198, 400, 401; 49/445–447
See application file for complete search history.

(56) References Cited

U.S. PATENT DOCUMENTS

| | | | | |
|---|---|---|---|---|
| 4,089,085 | A * | 5/1978 | Fitzgibbon | 16/197 |
| 5,530,991 | A * | 7/1996 | deNormand et al. | 16/198 |
| 6,467,128 | B1 * | 10/2002 | Damani | 16/197 |
| 6,598,264 | B2 * | 7/2003 | Newman | 16/197 |
| 6,887,187 | B1 | 5/2005 | Renz | |
| 7,069,621 | B2 * | 7/2006 | Malek | 16/194 |
| 7,155,778 | B2 * | 1/2007 | Newman | 16/197 |
| 2005/0126078 | A1 | 6/2005 | Newman | |
| 2006/0207185 | A1 * | 9/2006 | Shuler et al. | 49/445 |
| 2007/0067952 | A1 * | 3/2007 | Newman | 16/197 |

* cited by examiner

*Primary Examiner*—Victor Batson
*Assistant Examiner*—Emily M Morgan
(74) *Attorney, Agent, or Firm*—Brown & Michaels, PC

(57) ABSTRACT

An extended travel balance including a channel having a first end and a second end, a bottom pulley connected at the second end of the channel, and a bottom guide connectable at a location between the first end and the bottom pulley, and preferably between the bottom pulley and fixed pulleys of the end carriage. The bottom guide and top guide are not part of the tensioned parts in the channel and can, therefore, be stored separately from the channel with its tensioned parts—e.g., springs, pulleys, and pulley cord. Multiple bottom guide and top guide configurations can be mated to the channel with its tensioned parts without interfering with the operation of either. Fixed pulleys and bottom pulley of the end carriage are advantageously connected by an intermediate tensioned connector with all said parts held in tension between and by the connection of the bottom pulley to the tensioned pulley cord and the connection of the bottom pulley to the second end of the channel. The bottom guide in the preferred embodiment straddles said intermediate tensioned connector when connected to the channel.

17 Claims, 5 Drawing Sheets

EXTENDED TRAVEL WINDOW BALANCE

BACKGROUND OF THE INVENTION

1. Field of the Invention

The invention pertains to the field of block and tackle window balances. More particularly, the invention pertains to a block and tackle window balance which provides a sash mounted in a window frame with extended range of travel.

2. Description of Related Art

Typical hung window assemblies feature at least one moveable window sash mounted in a window frame. The sash slides up and down in the frame and is provided with a window balance of some type to counter the weight of the sash so that it can be easily moved up and down by the user. A popular configuration for window balances in this type of window uses a combination of springs and pulleys mounted in an elongate channel member to counterbalance the weight of the sash. The channel member has a generally "U" shaped cross-section for most or all of its length and can be mounted to the frame with a cord end attached to the sash. Alternately, as is the case in the embodiments related to this invention, the channel can be attached to the sash while the cord extends from the pulley elements in the channel via a pulley/roller at the lower end of the channel to connect to a side of the jamb above this "bottom" pulley/roller. (A jamb mounting hook positioned at the end of the cord is used to connect the cord to the jamb). However, in the latter embodiment, the range of travel of the sash in the frame is limited by the positioning of the bottom pulley/roller in the channel, which can interfere with the jamb mounting hook.

For ease of egress from the window in emergencies (and as a general matter of convenience) it is desirable for the window sash to have maximum upward travel in the window frame. This can be accomplished, and the problem of interference between the bottom pulley/roller and the jamb mounting hook alleviated, by moving the bottom pulley/roller for the jamb mounting hook closer to the lower end of the channel member. However, the upper and lower ends of the channel are usually taken up by, respectively, top and bottom guides that are attached to the channel and assist in connecting the channel to a window sash. This problem led to the initial attempted solution by U.S. Pat. Nos. 6,598,264 and 6,877,187; and application Ser. No. 11/029,074. The aforesaid patents and applications teach a system where a "bottom roller" is mounted in the bottom guide, combining the functions of these two parts. This does, in fact, serve to move this bottom roller closer to the end of the channel and create a system with greater travel. However, it leads to additional problems.

It is desirable in the window industry for parts to be as interchangeable as possible. Thus, in the prior art block and tackle window balances discussed it was not unusual to have systems where the tensioned elements (such as the springs, middle carriage assembly, cord, and end carriage assembly with bottom pulley) were mounted directly to the channel which could be stocked and/or stored as a stable assembly. This assembly could then be joined to different top and bottom guides as needed to fit different types, sizes and configurations of windows. However, this is no longer possible and/or is extremely limited by the types of configurations taught in U.S. Pat. Nos. 6,598,264 and 6,877,187; and in application Ser. No. 11/029,074. In these configurations, the bottom guide is included among the tensioned parts due to the fact that the bottom roller is mounted therein. Thus, it must be pre-mounted to the channel along with the other tensioned parts, limiting the ability of the channel to be used for multiple window types and severely limiting the usefulness of the channel as an interchangeable part.

SUMMARY OF THE INVENTION

We avoid the problems of prior art, including the recent patents and applications cited above, by moving the bottom guide to a position between the fixed pulleys of the end carriage assembly and the bottom pulley. In my system, the bottom guide is an untensioned insert. This allows a system that satisfies the need for easy adaptability and interchangeable parts, while simultaneously providing the extended travel sought in this field. Thus, in the preferred embodiments discussed below my invention is seen to be, in its most basic form, a channel having a first end and a second end; with a bottom pulley connected at the second end of the channel; and a bottom guide connectable intermediate the first end and the bottom pulley. The bottom guide and top guide are not part of the tensioned parts in the channel and can, therefore, be stored separately from the channel with its tensioned parts—e.g., springs, carriage assemblies, pulleys, bottom pulley and pulley cord. Multiple bottom guide and top guide configurations can be mated to the channel with its tensioned parts without interfering with the operation of either.

In the preferred embodiments, the end carriage assembly (which is fixed) has fixed pulleys that are connected to the bottom pulley by an intermediate tensioned connector. All three parts are held in tension between and by the connection of the fixed pulley to the tensioned pulley cord and the connection of said bottom pulley to the second end of the channel. The bottom guide is preferably configured so that it straddles the intermediate tensioned connector when it is inserted into and connected to the channel, and a bottom guide fastener can be provided to pass through the bottom guide and openings in the connector to connect the bottom guide to the channel.

These and numerous other features and advantages of my extended travel window balance will be better understood by review of the detailed description and claims that follow. However, they include or serve to create a compact, durable design that offers the versatility needed for an extended travel window balance that provides greater ease of egress from a window in emergencies by moving the bottom pulley for the jamb mounting hook closer to the lower end of the channel member while simultaneously producing a unit that avoids problems related to mounting the bottom pulley/roller in the bottom guide.

DETAILED DESCRIPTION OF THE INVENTION

Figure 1A:
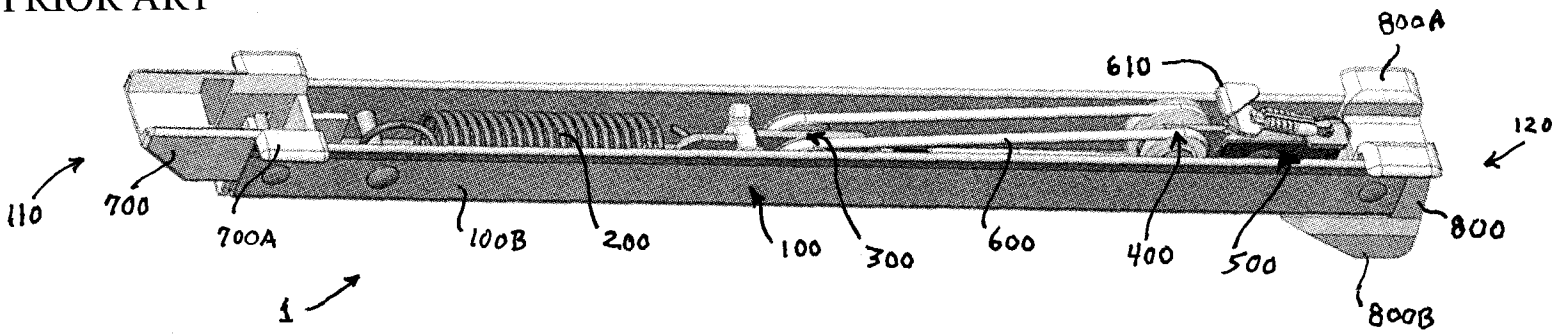
FIG. 1A PRIOR ART
FIG. 1A provides a first perspective view of an assembled prior art block and tackle balance.
Figure 1B:
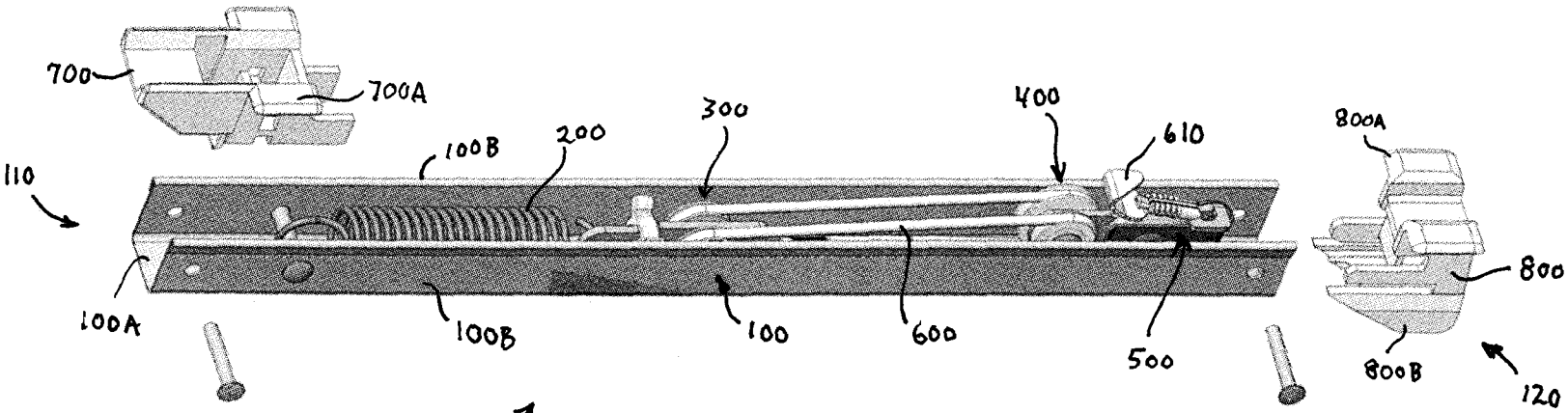
FIG 1B PRIOR ART
FIG. 1B provides a second perspective view of the assembled prior art block and tackle balance.
Figure 2A:
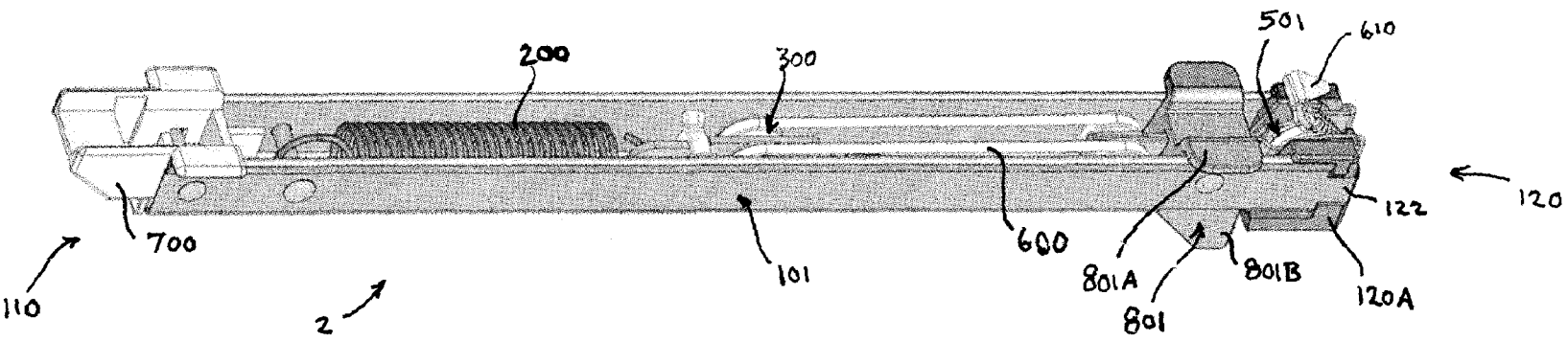
FIG. 2A provides a first perspective view of my extended travel block and tackle balance.
Figure 2B:
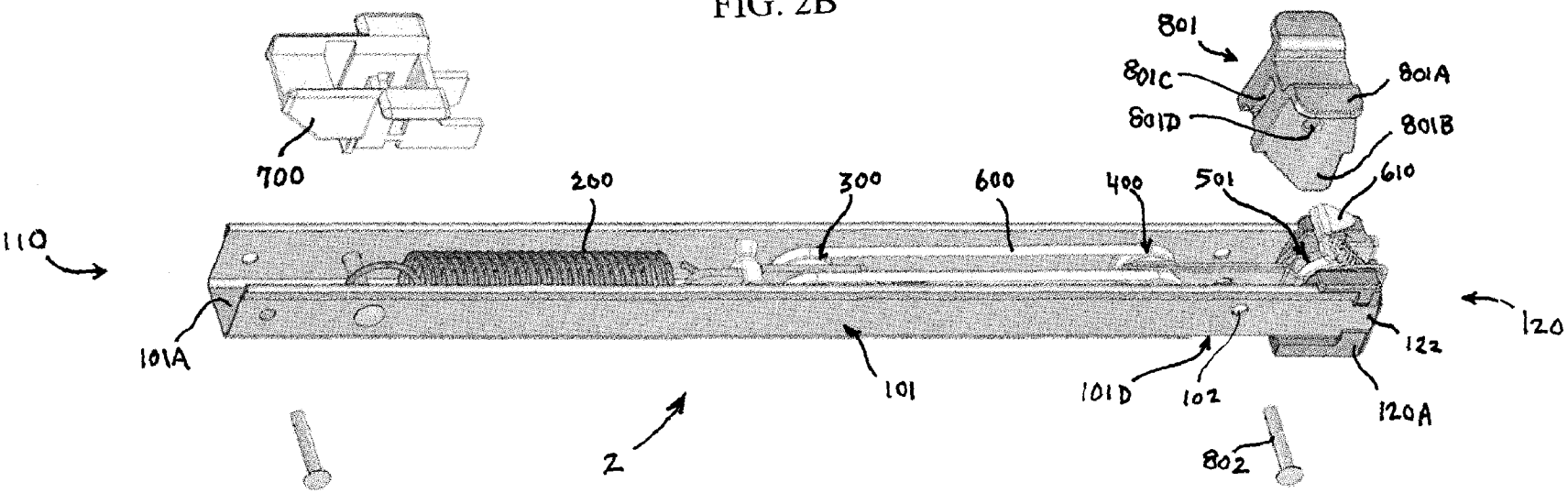
FIG. 2B provides a second perspective view of my extended travel block and tackle balance.
Figure 2C:
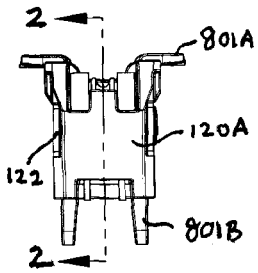
FIG. 2C provides an end view of the second end of my extended travel block and tackle balance.
Figure 2D:
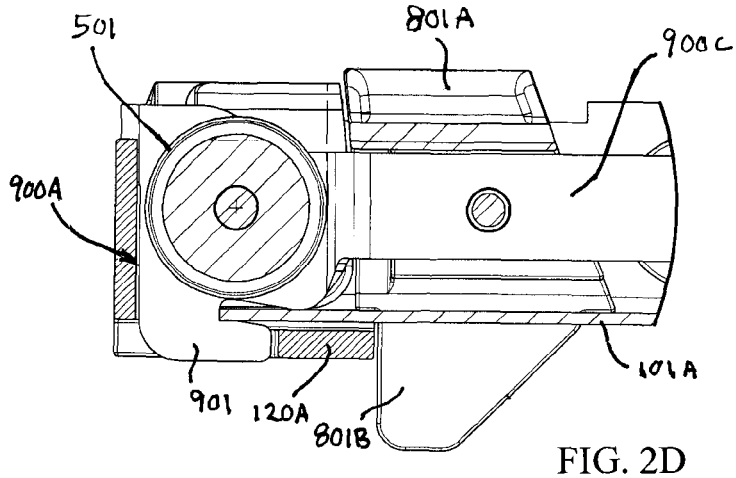
FIG. 2D provides a cross-sectional view of the second end of my extended travel block and tackle balance taken through 2-2 of FIG.2C.
Figure 3A:
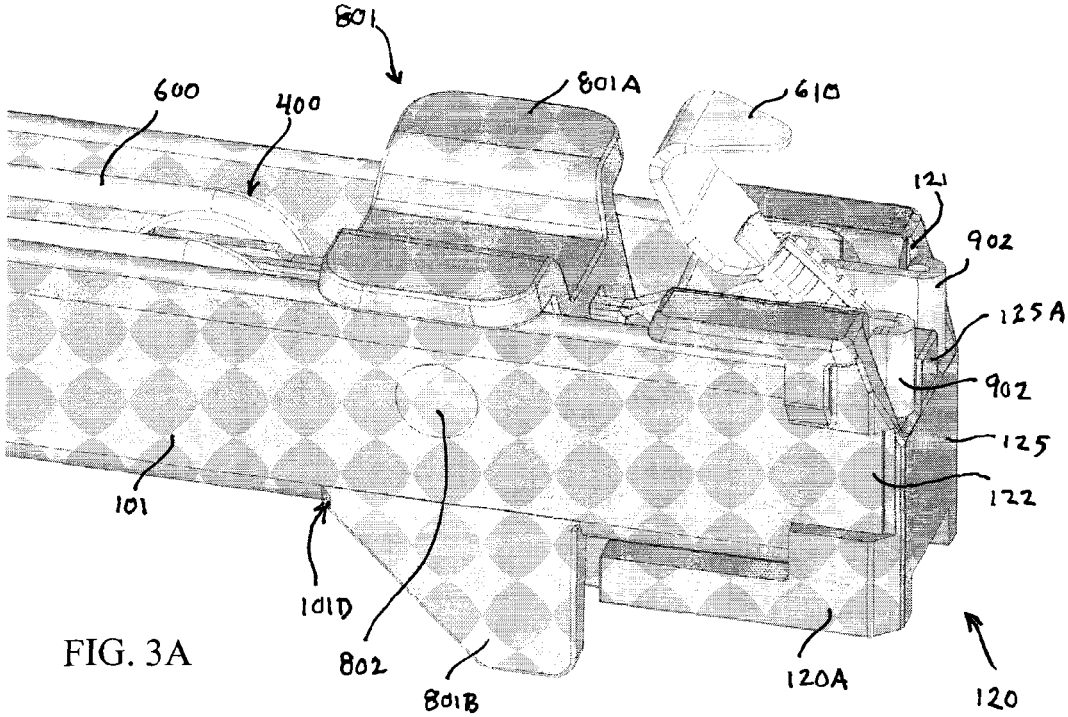
FIG. 3A provides a detailed perspective view of the second end of my extended travel block and tackle balance.
Figure 3B:
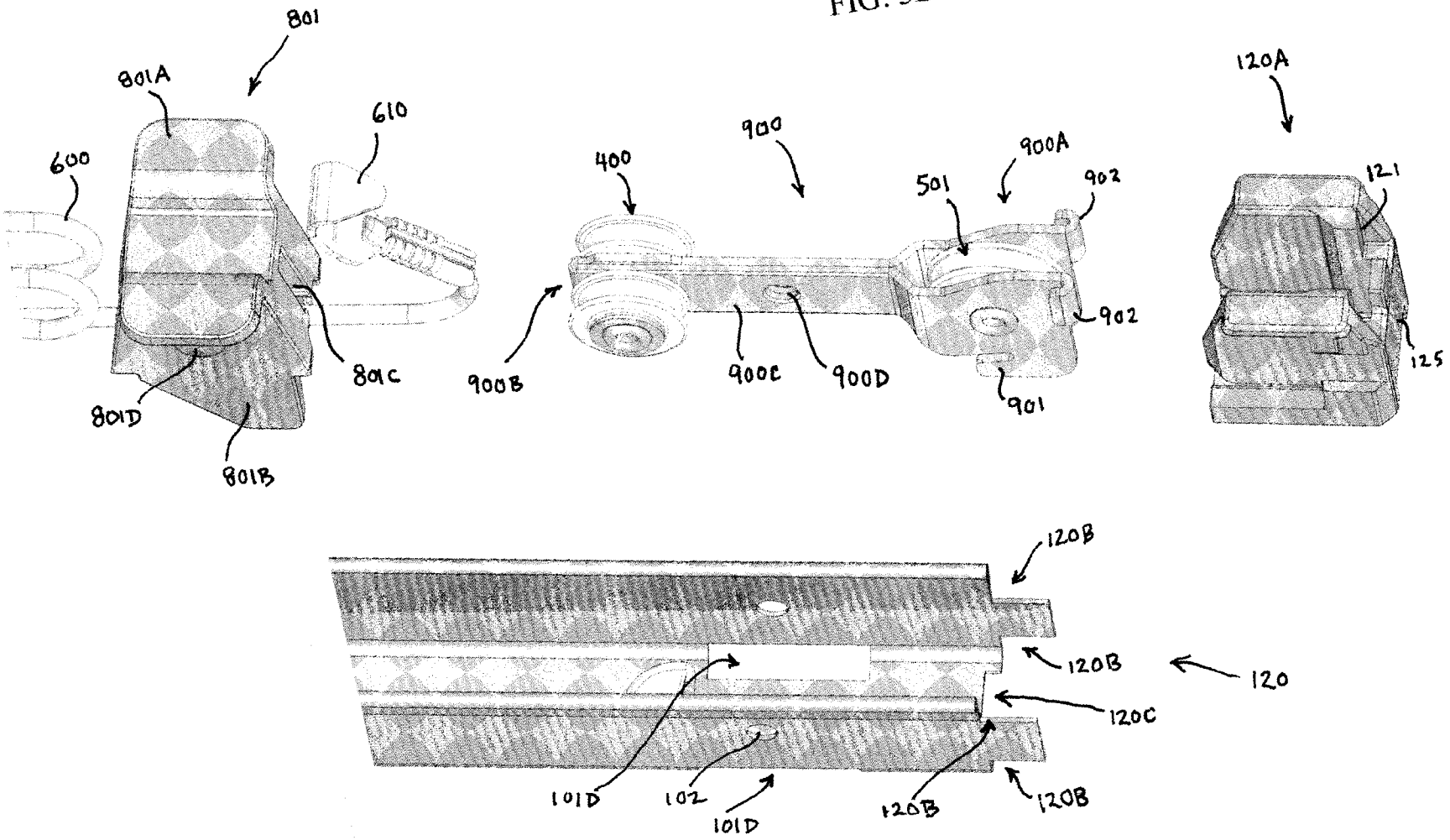
FIG. 3B provides an exploded perspective view of the second end of my extended travel block and tackle balance.
Figure 3C:
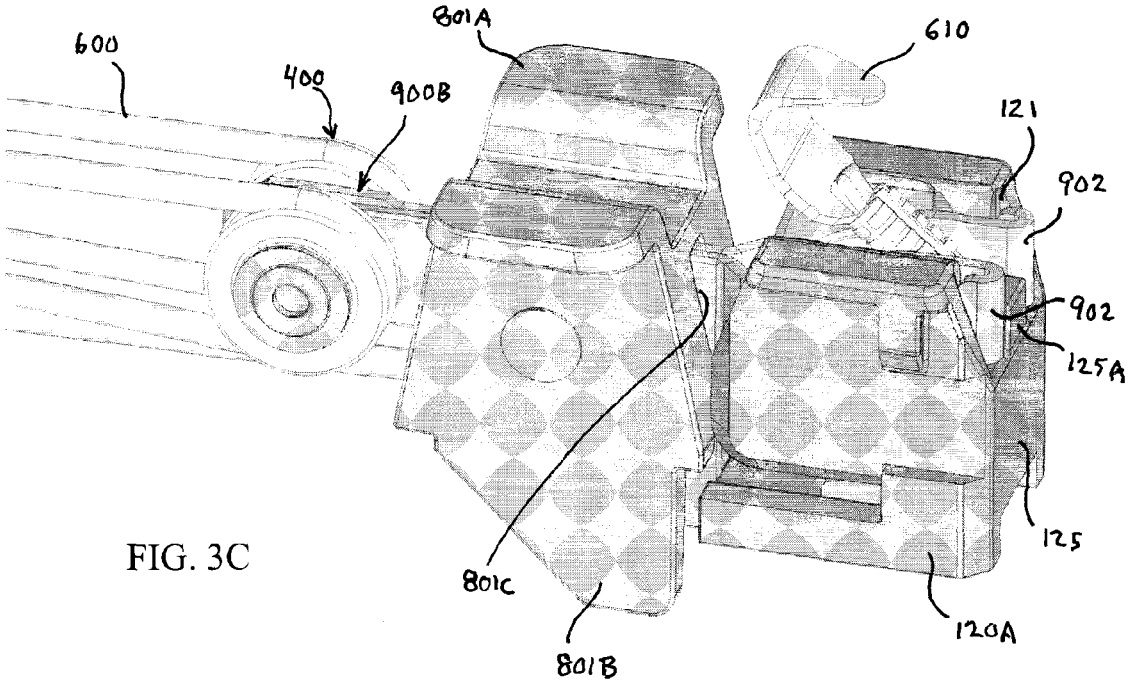
FIG. 3C provides a perspective view of certain key interior components of my extended travel block and tackle balance.

As illustrated in FIGS. 1A and 1B, prior art block and tackle window balances 1 intended for channel/sash attachment generally include a generally U-shaped channel 100 defined by a back 100A and two opposed sides 100B in which are mounted a spring 200, a moveable middle carriage pulley assembly 300, a fixed end carriage pulley assembly 400, a bottom pulley 500, and a cord 600. A top guide 700 is affixed at a first end 110 of U-shaped channel 100, with a bottom guide 800 attached at a second end 120. Guides 700, 800 are used to connect the U-shaped channel 100 of the window balance to a window sash and to help guide its vertical movement within jamb frame channels as the sash is moved up and down. With channel 100 firmly attached to a sash, a jamb mounting hook 610 the end of cord 600 can be run upward and affixed to the adjacent jamb of the window frame. In this way, the upward pull produced by the aforesaid components of the prior art block and tackle balance 1 acting together can, as is well known in the art, counterbalance the weight of a sash. This allows the sash to be easily moved up and down within the window frame and to maintain a steady position when left at any location in its normal zone of vertical movement. However, in order to increase vertical travel it is necessary to move the bottom pulley 500 for the cord 600 end terminating in jamb mounting hook 610 closer to the second end 120 of the channel 100.

My solution to this problem is best understood by reference to FIGS. 2A through 3C. Like the prior art embodiments previously discussed, the preferred embodiments illustrated in these drawing figures have a channel (extended travel channel 101) with a first end 110 and a second end 120. However, extended travel bottom pulley 501 is mounted at one end of an end carriage comprising an extended member 900 with a fixed pulleys mounting end 900A and a bottom pulley mounting end 900B joined by an intermediate connector 900C. An end cap 120A mounts at the terminal end 122 of second end 120, interfacing with corner cut-outs 120B provided in second end 120.

End cap 120A serves two general purposes. First, it is necessary, and is used, to hold hook 610 in functional position (as shown in the drawing figures). Without end wall 125 and end wall extension 125A, hook 610 would be pulled by pressure on cord 600 around bottom pulley 501 to a position on the other side of extended travel channel 101 adjacent back 101A. In addition, it has been found that versions of spring 200 with greater tension require not just dorsal hooks 901 on pulley mounting end 900A (which hook onto the back 101A of extended travel channel 101 at bottom cut-out 120C) for proper stabilization, but lateral hooks 902 anchored in the positions shown. Lateral hooks 902 could be mounted directly to extended travel channel 101, but by mounting them to end cap 120A via mounting ledges 121 they also serve to hold the end cap 120A firmly in position so that it can accomplish its functions as part of the design.

Bottom pulley mounting end 900B provides a mount for fixed pulleys 400, which are connected by cord 600 to spring 200 via middle carriage pulleys 300. Hence, all of these parts are under tension provided by spring 200. In contrast to these tensioned parts, extended travel bottom guide 801 is not under tension. It is connectable intermediate top guide 700 (which is located at first end 110) and extended travel bottom roller 501 (which is located at second end 120). The bottom guide 801 is, as illustrated, preferably configured so that it straddles the intermediate tensioned connector 900C of the end carriage via slot 801C when it is inserted into and connected to channel 101. A bottom guide fastener 802 can be passed through channel openings 102, bottom guide openings 801D, and connector openings 900D to connect the bottom guide 801 to extended travel channel 101. Channel slots 101D are provided in the back 101A of extended travel channel 101, allowing dorsal extensions 801B to be inserted therethrough when the bottom guide 801 is inserted into channel 101. Once dorsal extensions 801B are locked into channel slots 101D and bottom guide fastener 802 is passed through bottom guide 801, it is firmly and rigidly held in position, allowing it to serve its purpose in interfacing with a window sash. This configuration can also serve to further stabilize extended member 900 and its connected parts.

As previously noted, my invention allows the easy substitution of top and bottom guides as needed for particular applications in constructing balances. Thus, my invention can be used with top guides and bottom guides that are configured in various ways, such as with or without lateral extensions 700A, 800A, 801A, or that have different critical dimensions as necessary for different sizes and types of window sashes. These and numerous other variations are possible without exceeding the scope of the inventive concept. Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

PARTS LIST

1 Block and tackle window balance (Prior Art)
2 Extended travel block and tackle window balance
100 U-shaped channel
100A Back of U-shaped channel
100B Sides of U-shaped channel
101 Extended travel channel
102 Channel openings
101A Back of extended travel channel
101D Channel slots
110 First end of channel
120 Second end of channel
120A End cap
120B Corner cut-outs
120C Bottom cut-out
121 Mounting ledges
122 Terminal end
125 End wall
125A End wall extension
200 Balance spring
300 Moveable pulleys of middle carriage assembly
400 Fixed pulleys of end carriage assembly
500 Bottom pulley
501 Extended travel bottom pulley
600 Balance cord
610 Jamb mounting hook
700 Top guide
700A Lateral extensions
800 Bottom guide
800A Lateral extensions
800B Dorsal extensions
801 Extended travel bottom guide
801A Lateral extensions
801B Dorsal extensions
801C Slot in bottom guide

801D Bottom guide openings

802 Bottom guide fastener

900 Extended member of end carriage assembly

900A Roller mounting end of extended member extended carriage assembly

900B Bottom pulley mounting end of end carriage assembly

900C Intermediate connector of end carriage assembly

900D Connector openings of end carriage assembly

901 Dorsal hooks of end carriage assembly

902 Lateral hooks of end carriage assembly

What is claimed is:

1. In a non-tilting sash balance including an extended travel block and tackle arranged within a channel to apply tension of a spring to tensioned elements comprising fixed pulleys arranged in a bottom region of a channel, a bottom pulley arranged below the fixed pulleys, and a connector connecting the bottom pulley to the fixed pulleys, the improvement comprising:

a bottom guide placed within the channel between side walls of the channel in a space spanned by the connector between the fixed and bottom pulleys;

the connector being configured so that the space spanned by the connector leaves room between the side walls of the channel to receive the bottom guide; and the bottom guide is mounted independently of the tensioned elements, so that the bottom guide is not subject to the spring tension and can be inserted into the channel after the spring tension is applied to the tension elements.

2. The balance system of claim 1 including slots formed in a bottom of the channel in the space between the fixed and bottom pulleys, and surfaces of the bottom guide project through the channel slots.

3. The balance system of claim 1 including a channel end cap positioned to prevent unwrapping of a cord termination from the bottom pulley.

4. The balance system of claim 3 wherein the connector engages the end cap and urges the end cap against an end of the channel.

5. The balance system of claim 1 wherein the bottom guide straddles the connector.

6. A non-tilting window sash balance formed as an extended travel block and tackle with tensioned elements comprising a spring, a cord, fixed pulleys, a bottom pulley, and a connector of the fixed and bottom pulleys, all arranged within a channel, the balance comprising:

a bottom guide is positioned in the channel between side walls of the channel and between the fixed pulleys and the bottom pulley;

the bottom guide straddles the connector; and the bottom guide is not subject to the spring tension applied to the tensioned elements so that the bottom guide can be inserted into the channel after tensioning the tensioned elements.

7. The balance of claim 6 wherein a pair of slots is formed in a bottom of the channel on opposite sides of the connector, and the bottom guide has surfaces that extend through the slots.

8. The balance of claim 6 including an end cap engaged by the connector and disposed to prevent unwrapping of a cord termination from the bottom pulley.

9. A non-tilting window sash balance including tensioned elements of an extended travel block and tackle comprising a spring, a cord, fixed pulleys, a bottom pulley, and a connector of the fixed and bottom pulleys all arranged within a channel, the balance comprising:

the connector extends across an open space within the channel between the fixed pulleys and the bottom pulley and holds the fixed and bottom pulleys apart against the tension of the spring and cord;

a bottom guide is positioned in the channel in the space spanned by the connector between the fixed and bottom pulleys; and the bottom guide is not subject to the tension of the spring and cord so that the bottom guide can be positioned in the channel after assembly of tensioned elements.

10. The balance of claim 9 wherein the bottom guide straddles the connector.

11. The balance of claim 9 wherein the bottom guide has surfaces that extend through slots in a bottom of the channel to engage the sash.

12. A non-tilting sash balance including an extended travel block and tackle with fixed pulleys and a bottom pulley separated by a connector and arranged within a channel, the balance comprising:

the connector spans an open space within the channel between the fixed and bottom pulleys;

a bottom guide placed within the channel between the channel side walls in the space spanned by the connector;

the bottom guide straddles the connector;

a pair of slots on opposite sides of the connector are formed in a bottom of the channel; and the bottom guide has surfaces extending through the slots.

13. The balance of claim 12 including a channel end cap engaged by the connector and disposed to prevent unwrapping of a cord termination from the bottom pulley.

14. A non-tilting window sash extended travel block and tackle balance including tensioned elements comprising a spring, a cord, fixed pulleys, a bottom pulley, and a connector of the fixed and bottom pulleys, all arranged within a channel, the balance comprising:

the connector separates the fixed pulleys from the bottom pulley to leave a space within the channel between the fixed and bottom pulleys;

a bottom guide is positioned within the channel in the space between the fixed and bottom pulleys;

an end cap engaged by the connector is urged against a bottom end of the channel; and the bottom guide is not tensioned by any of the tensioned elements.

15. The balance of claim 14 wherein the end cap is positioned to prevent unwrapping of the cord and a cord end termination from the bottom pulley.

16. The balance of claim 14 wherein the bottom guide straddles the connector.

17. The balance of claim 14 wherein the bottom guide has surfaces that extend through slots in a bottom of a channel.

* * * * *